United States Patent [19]

Curchack et al.

[11] 4,345,460

[45] Aug. 24, 1982

[54] MULTI-CALIBER PROJECTILE SOFT RECOVERY SYSTEM

[75] Inventors: Herbert D. Curchack, Rockville, Md.; A. David Hahn, Haven Beach, N.J.

[73] Assignee: The United States of America as represented by the Secretary of the Army, Washington, D.C.

[21] Appl. No.: 158,556

[22] Filed: Jun. 11, 1980

[51] Int. Cl.[3] ..... G01L 5/14

[52] U.S. Cl. ..... 73/167

[58] Field of Search ..... 73/167, , 432 SD

[56] References Cited

U.S. PATENT DOCUMENTS

| | | | |
|---|---|---|---|
| 2,813,422 | 11/1957 | Schuessler | 73/167 |
| 3,217,534 | 11/1965 | Bingham et al. | 73/167 |
| 3,218,849 | 11/1965 | Marvinney et al. | 73/167 |
| 3,314,286 | 4/1967 | Hickerson et al. | 73/167 |
| 3,396,971 | 8/1968 | Estep | 273/102 |
| 3,678,745 | 7/1972 | Teng | 73/167 |
| 3,940,981 | 3/1976 | Covey et al. | 73/167 |
| 4,002,064 | 1/1977 | Curchack | 73/167 |

*Primary Examiner*—Donald O. Woodiel

*Attorney, Agent, or Firm*—Nathan Edelberg; Robert P. Gibson; Saul Elbaum

[57] ABSTRACT

An apparatus and method for soft recovery of a projectile is disclosed. A deformable element is placed in the path of the projectile, whereby the projectile becomes embedded in the element upon impact therewith. Gravitational or mechanical forces are applied to the combined projectile and deformable element to decelerate the same thereby making recovery possible.

6 Claims, 2 Drawing Figures

MULTI-CALIBER PROJECTILE SOFT RECOVERY SYSTEM

RIGHTS OF THE GOVERNMENT

The invention described herein may be manufactured and used by or for the U.S. Government for governmental purposes without payment to us of any royalty thereon.

BACKGROUND OF THE INVENTION

It is often necessary, both for the reason of safety and for testing purposes, to recover a projectile in an intact form. Various methods and devices have been developed to accomplish this result. Most are rather complex, costly, and difficult to utilize. Additionally, some soft recovery techniques are suitable for laboratory use only.

One method of soft recovery for projectiles involves directing the projectile down a closed tubular member while developing high gaseous pressure in front of the moving projectile. The pressure decelerates the projectile whereby it may be recovered in an intact form. U.S. Pat. Nos. 3,678,745; 3,940,981 and 4,002,064 are examples of such a soft recovery technique. While such a method is effective, most prior art methods of this type have required sophisticated and expensive equipment, and are generally not well suited to the recovery of standard projectiles fired from ordinary weapons.

U.S. patent application Ser. No. 157,145, filed June 6, 1980 by Frank L. Tevelow, discloses an improvement over these prior art methods. The technique of that disclosure involves firing a standard shell into an object in which the shell becomes embedded. The object and shell are decelerated as they travel through a tube in which high gaseous pressure is developed. Alternatively, frictional forces at the interface of the moving object and the tube wall will decelerate the shell or projectile. This technique obviates the need for relatively expensive and sophisticated apparatus, and is also suited for use with standard shells or projectiles. However, it suffers from the drawback that it is suited to the recovery of only those projectiles having a rifling band or other annular protrusion associated therewith. Furthermore, the element in which the projectile becomes embedded must be particularly dimensioned to properly mate with the specific projectile being tested.

Another soft recovery technique known in the art involves firing a projectile along a set of rails which are partially submerged in water. A specially configured nose attached to the projectile scoops up the water, thereby providing deceleration forces. This method is also only suited for laboratory use due to the fact that a controlled environment and specially adapted equipment must be provided in order to decelerate the projectile. Additionally, if the projectile being tested has a rifling band attached thereto, means must be provided for stripping this band from the projectile so that the projectile may be properly accommodated by the rails.

U.S. Pat. No. 3,314,286 discloses a projectile recovery device which is suitable for field use. The device of the patent comprises a ring-like attachment to be fitted to the end of a gun barrel. The attachment is so configured as to catch the rifling band of the projectile thereby becoming attached to the projectile in its flight. A cable and balloon or other drag inducing object are secured to the ring-like fitting to provide deceleration forces for the projectile. Use of this device is very cumbersome as it is necessary to attached a very long drag line and balloon to the projectile recovery device. The device also suffers from the drawback that any particular fitting attached to the end of the gun barrel is capable of accommodating projectiles of only a single dimension. This necessitates stock piling a large number of assorted sized fittings in order to provide the capability of capturing and recoverying projectiles of various sizes. More importantly, the acquisition of the fitting produces substantial reverse acceleration forces on the projectile.

It is therefore an object of this invention to overcome the above noted drawbacks in the prior art techniques and devices.

It is an object of this invention to provide a projectile soft recovery apparatus suitable for use in the field and in the laboratory.

It is another object of this invention to provide a soft recovery system which may be adapted to insure the safety of personnel operating a weapon which may also be adapted to laboratory testing purposes.

It is another object of the invention to provide a soft recovery system which is adapted to use with a variety of standard projectiles.

It is a further object of the invention to provide a soft recovery system for projectiles wherein a single element of apparatus may be used to recover projectiles of varying dimensions.

It is yet another object of the invention to provide a soft recovery system which is inexpensive, requiring no complex equipment or devices, and requiring no power input for the operation of the system.

SUMMARY OF THE INVENTION

The system of the present invention comprises a deformable object placed in the path of the projectile to be recovered. Upon deformation the projectile becomes embedded in the object without the projectile itself becoming deformed. The projectile and object may then be easily decelerated by gravitational or aerodynamic forces or mechanical means.

DESCRIPTION OF A PREFERRED EMBODIMENT

Figure 1:
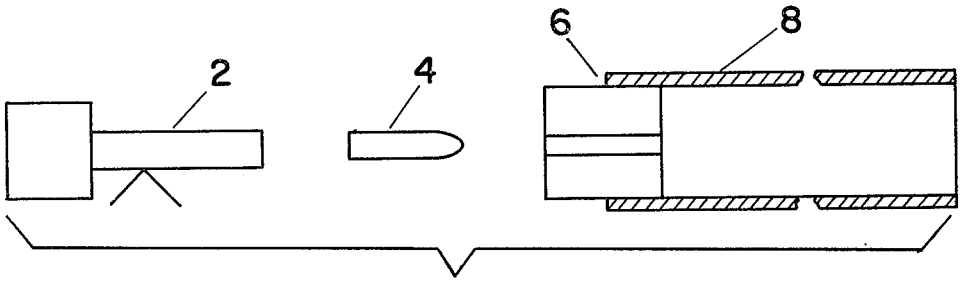
FIG. 1 shows an arrangement of elements which comprises an embodiment of the present invention.

Referring to FIG. 1 of the drawings, a weapon 2 which may be of any variety, is adapted to fire a projectile 4. When it is desired to recover the projectile in its intact form, deformable object 6 is placed in its path whereby the projectile will impact with the deformable object. The projectile 4 will burrow into the object 6, will experience a controlled deceleration, and will lodge therein. The additional mass of the deformable object will immediately reduce the velocity of the combined projectile and object to a rate significantly less than the velocity of the projectile alone. In the embodiment of FIG. 1, the projectile and deformable object 6 will then proceed through the tube 8 whereby frictional and aerodynamic interaction between the tube and the deformable object will rapidly decelerate the projectile 4 and the object 6.

This invention makes novel use of an aluminum honeycomb material (TUBECORE, a product of the Hexcel Corporation) for the deformable object. Specifically, the object comprises multiple layers of 10 corrugated aluminum material rolled upon itself to form a tubular structure having an interior opening 12. As the projectile impacts with the tubular element 6, the inner layers of the corrugated material are pushed or crushed outwardly whereby central opening 12 expands to accommodate the projectile. This expansible feature enables a single element 6 to accommodate a broad range of projectile sizes.

Figure 2:
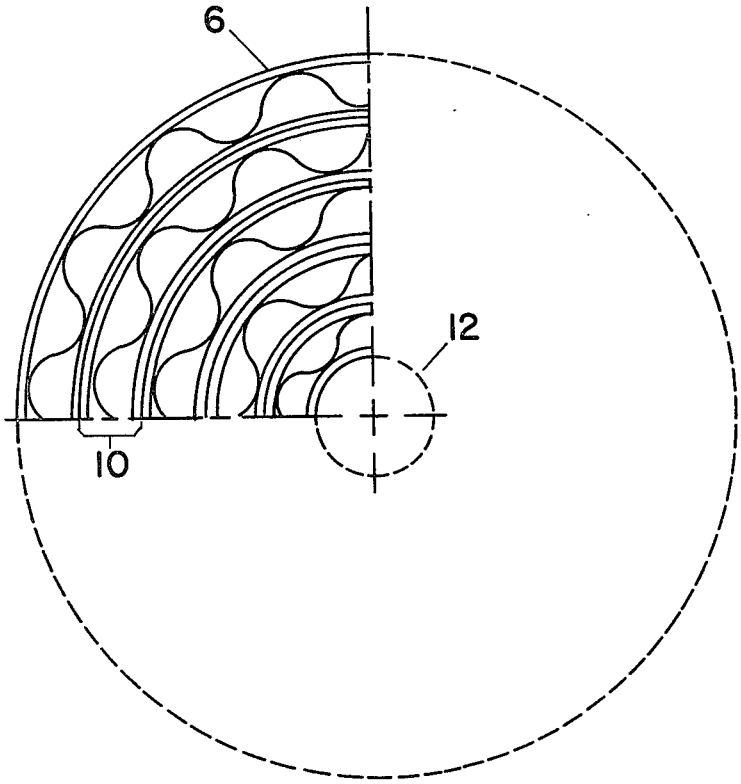
FIG. 2 illustrates a preferred form of the deformable object of the present invention.

By varying the strength of density and the material which comprises the deformable element 6, the deceleration forces applied to the impacting projectile may be varied. Also, the embodiment of the deformable object shown in FIG. 2 has a self-centering capability. The layers of the corrugated material will tend to center the projectile in the object 6 as the layers are pushed outwardly upon impact. Alignment of the weapon and the object 6 is therefore not critical. While the interior layers of the object 6 are expanded outwardly to accommodate the projectile, the outer-most layers remain unaffected by the impact. The outer dimension of the tubular object remains therefore unchanged, enabling it to properly interact with the deceleration tube 8.

Deceleration of the combined projectile and deformable object may be accomplished by gravitational and aerodynamic forces only, thereby obviating the need for deceleration tube 8. A tubular member 6 may be positioned in front of the weapon 2 in such manner that the projectile 4 will impact therewith. The added mass of the object 6 will cause the projectile to decelerate rapidly thereby causing its trajectory to terminate rapidly and predictably.

In addition to being capable of handling projectiles of several calibers, the apparatus and method of the present invention possess other significant advantages. For testing and research purposes, no modifications of the projectile is required as is often the case in recovery systems utilizing gaseous compression or fluid deceleration techniques. This allows testing of a projectile with all of its components constructed and assembled in standard operating configurations.

Due to the self-centering capability of the present device, the recovery system location with respect to the weapon is less critical than with other techniques. There is no need to provide complex and costly devices to properly position the recovery apparatus with respect to the weapon. The present apparatus may therefore be readily adapted for use with mortars, artillery, recoilless rifles, or any other weapon without the need for special interface devices.

When the present apparatus is utilized to recover shells or projectiles which comprises a rifling ring it is not necessary to provide means to strip this ring from the projectile as is often the case when utilizing prior art techniques or devices. The device of the present invention functions equally well when recovering projectiles with or without a rifling band.

The present invention is especially suitable for assuring the safety of gun crews in the event of a hangfire. If a shell fails to fire during testing or combat conditions, special procedures must be followed to ensure safe disposition of the shell and protection of the crew. Some weapons have "dead" times, that is times during which the crew must wait in the event of misfire. If the shell should fire in this time, it does so in a non-predictable manner. By placing a deformable tubular member of the present invention in front of the weapon one would assure that a randomly firing shell would be decelerated to a velocity where it could be safely recovered after a relatively short and predictable trajectory.

Once the combined deformable object and projectile is recovered, the tubular object may be readily cut away from the shell if it is desired to inspect or further test the projectile. Alternately, if the projectile is one which has no explosive charge, the shell and the deformed object may be jointly disposed of.

When utilizing the deceleration tube 8 as shown in FIG. 1, it is possible, if desired, to provide means to generate a relatively high gaseous pressure in the tube in front of the combined projectile and object 6. This would result in more rapid deceleration of the moving object, and may be accomplished by simply closing off the distal end of the tube 8, as more fully described in the aforementioned application Ser. No. 157,145. The gaseous pressure is of course not necessary and the present invention will decelerate the projectile rapidly and effectively without the utilization of such means.

The present invention represents an improvement over the device disclosed in application Ser. No. 157,145. The deformable means 6 of the present invention is simpler and less costly to fabricate than the composite means disclosed in Ser. No. 157,145. While the device of that application must be fabricated with differing dimensions for each projectile type tested, the present apparatus can accomodate many different projectiles using a single type of deformable means 6. Futhermore, the present device works equally well for any type of projectile, while the device of Ser. No. 157,145 functions properly only when the projectile comprises a rifling band.

While the invention has been described with respect to the accompanying drawings, we do not wish to be limited to the details disclosed therein as obvious modifications may be made by one of ordinary skill in the art.

We claim:

1. A projectile soft recovery system comprising an object placed in the path of said projectile whereby said projectile becomes embedded in said object, and means to decelerate said object with the projectile embedded therein, wherein said object comprises means for accommodating projectiles of varying sizes.

2. A system as in claim 1 wherein said object comprises means for accommodating projectiles of varying configurations.

3. A system as in claim 1 or 2 wherein said object is deformable.

4. A system as in claim 3 wherein said object comprises a tubular structure capable of internal deformation sufficient to accommodate projectiles of varying dimensions and configurations.

5. A system as in claim 4 wherein said tubular structure comprises corrugated material.

6. A system as in claim 5 wherein said object consists of substantially concentric layers of corrugated metallic material.

* * * * *